US005258773A

United States Patent [19]

Arakawa et al.

[11] Patent Number: 5,258,773

[45] Date of Patent: Nov. 2, 1993

[54] SERIAL RECORDING APPARATUS FOR BIDIRECTIONAL RECORDING

[75] Inventors: Junichi Arakawa, Yokohama; Kazuyuki Masumoto, Tokyo, both of Japan

[73] Assignee: Canon Kabushiki Kaisha, Tokyo, Japan

[21] Appl. No.: 646,246

[22] Filed: Jan. 28, 1991

[30] Foreign Application Priority Data

Feb. 2, 1990 [JP] Japan ..... 2-22177
Jul. 25, 1990 [JP] Japan ..... 2-198851

[51] Int. Cl.[5] ..... B41J 2/05; B41J 19/14

[52] U.S. Cl. ..... 346/1.1; 346/139 R; 346/140 R; 400/279; 400/323

[58] Field of Search ..... 400/323, 322, 279, 126; 346/140 R, 1.1, 139 R

[56] References Cited

U.S. PATENT DOCUMENTS

| | | | |
|---|---|---|---|
| 4,198,170 | 4/1980 | Decker | 400/323 |
| 4,313,124 | 1/1982 | Hara | 346/140 R |
| 4,313,684 | 2/1982 | Tazaki et al. | 400/322 |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,550,320 | 10/1985 | Biser et al. | 346/75 |
| 4,558,333 | 12/1985 | Sugitani et al. | 346/140 R |
| 4,723,129 | 2/1988 | Endo et al. | 346/1.1 |
| 4,740,796 | 4/1988 | Endo et al. | 346/1.1 |
| 5,018,884 | 5/1991 | Hirano et al. | 400/126 |
| 5,069,556 | 12/1991 | Sasaki et al. | 400/322 X |

FOREIGN PATENT DOCUMENTS

| | | | |
|---|---|---|---|
| 0053076 | 6/1982 | European Pat. Off. . | |
| 0263688 | 4/1988 | European Pat. Off. . | |
| 2390287 | 12/1978 | France . | |
| 2554050 | 5/1985 | France . | |
| 0138238 | 12/1978 | Japan | 400/279 |
| 54-56847 | 5/1979 | Japan . | |
| 57-045070 | 3/1982 | Japan . | |
| 0160683 | 10/1982 | Japan | 400/322 |
| 58-062084 | 4/1983 | Japan . | |
| 59-083675 | 5/1984 | Japan . | |
| 59-123670 | 7/1984 | Japan . | |
| 59-138461 | 8/1984 | Japan . | |
| 60-71260 | 4/1985 | Japan . | |
| 61-27194 | 6/1986 | Japan . | |
| 0123559 | 6/1986 | Japan | 400/323 |
| 0077967 | 4/1987 | Japan | 400/322 |
| 0286777 | 12/1987 | Japan | 400/322 |
| 0035374 | 2/1988 | Japan | 400/323 |

*Primary Examiner*—Joseph W. Hartary
*Assistant Examiner*—Alrick Bobb
*Attorney, Agent, or Firm*—Fitzpatrick, Cella, Harper & Scinto

[57] ABSTRACT

A serial recording apparatus for reciprocating a recording head with respect to a recording medium to perform bidirectional recording includes a position detector for detecting a reference position of the recording head, a driving unit for reciprocating the recording head within a predetermined area including the reference position, a calculating unit for calculating a difference between reference positions detected by the position detector by reciprocal movement when the recording head is reciprocated by the driving unit within the predetermined area, and a correcting unit for correcting a positional error in bidirectional recording on the basis of the difference calculated by the calculating unit.

80 Claims, 13 Drawing Sheets

| |
|---|
| FIG. 10A |
| FIG. 10B |

SERIAL RECORDING APPARATUS FOR BIDIRECTIONAL RECORDING

BACKGROUND OF THE INVENTION

1. Field of the Invention

The present invention relates to a serial recording apparatus for performing bidirectional recording upon reciprocal movement of a recording head.

2. Related Background Art

In a conventional serial recording apparatus, a recording head is reciprocated to perform high-speed bidirectional recording. In this serial recording apparatus, when a drive signal (i.e., drive pulses when a recording head is to be moved using a pulse motor) necessary for moving a recording head is applied, a delay time occurs until the recording head reaches a target position. Print errors occur during bidirectional recording due to various types of electrical and mechanical variations.

In order to correct positional errors in both directions in a conventional apparatus, as described in Japanese Patent Publication No. 61-27194, pulses and time are shifted using a DIP switch or jumper wire while an operator observes an actual print result, thereby adjusting such an error in each apparatus.

The above conventional recording apparatus poses the following problems.

(1) Extra circuit parts such as a DIP switch or jumper wire are required.

(2) Adjustment is time-consuming since it is performed while the operator observes the print result.

(3) When a load varies due to deteriorations over time, an initial adjustment value is changed, resulting in an unstable state.

On the other hand, in recent years, an ink-jet recording apparatus for causing a change in state (e.g., film boiling) of an ink by heat energy, for ejecting the ink to a recording medium by using bubbles generated by the change in state of the ink, and for recording a character or graphic image has been developed. The size of a heating resistor (heater) arranged in each ejection port is considerably smaller than that of a piezoelectric element used in a conventional ink-jet recording apparatus. For this reason, a high-density multiple arrangement of ejection ports can be obtained, a high-quality recording image can be obtained, and characteristics such as a high-speed operation and low noise can be obtained.

Of various types of ink-jet recording apparatuses, there is provided an apparatus using a recording head which has an ink tank and is detachable from a carriage. In this ink-jet recording apparatus, when bidirectional recording is performed to achieve recording at a higher speed, the following problems are posed.

Since the weight of the ink within the ink tank is changed (decreased) by use of the ink, a drive load of a carriage motor greatly varies. For this reason, the problem (3) becomes more conspicuous.

SUMMARY OF THE INVENTION

It is an object of the present invention to provide a serial recording apparatus capable of reciprocating a recording head with high precision.

It is another object of the present invention to provide a serial recording apparatus capable of performing bidirectional recording with high precision.

It is still another object of the present invention to provide a serial recording apparatus capable of performing bidirectional recording with high precision regardless of load variations in a carriage motor.

It is still another object of the present invention to provide a serial recording apparatus capable of automatically adjusting a recording error in bidirectional recording.

In order to achieve the above objects of the present invention, there is provided a serial recording apparatus for reciprocating a recording head with respect to a recording medium to perform bidirectional recording, comprising:

position detecting means for detecting a reference position of the recording head;

driving means for reciprocating the recording head within a predetermined area including the reference position;

means for calculating a difference between reference positions detected by the position detecting means by reciprocal movement when the recording head is reciprocated by the driving means within the predetermined area; and means for correcting a positional error in bidirectional recording on the basis of the difference calculated by the calculating means.

According to the present invention, upon a power-on operation or switching from an off-line mode to an on-line mode, since the difference between the reference positions detected by the position detecting means in both directions is calculated, a print position error in bidirectional recording can be automatically adjusted by using the difference.

DETAILED DESCRIPTION OF THE PREFERRED EMBODIMENTS

Serial recording apparatuses according to preferred embodiments of the present invention will be described with reference to the accompanying drawings.

Figure 1:
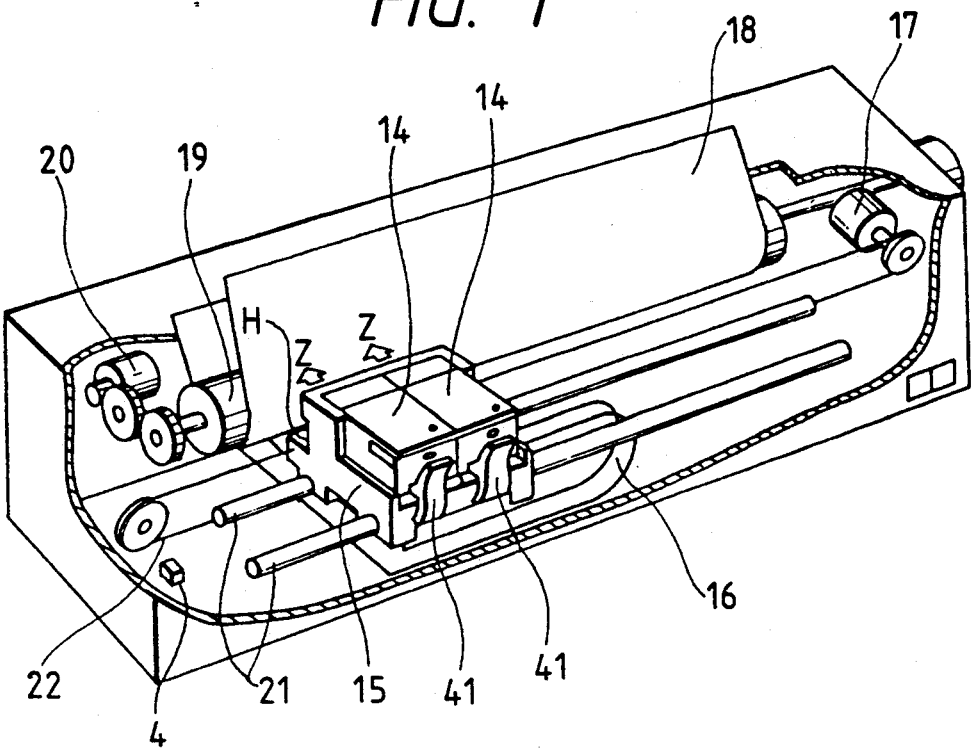
FIG. 1 is a partially cutaway perspective view showing an arrangement of an ink-jet recording apparatus according to the first embodiment of the present invention.
Figure 2:
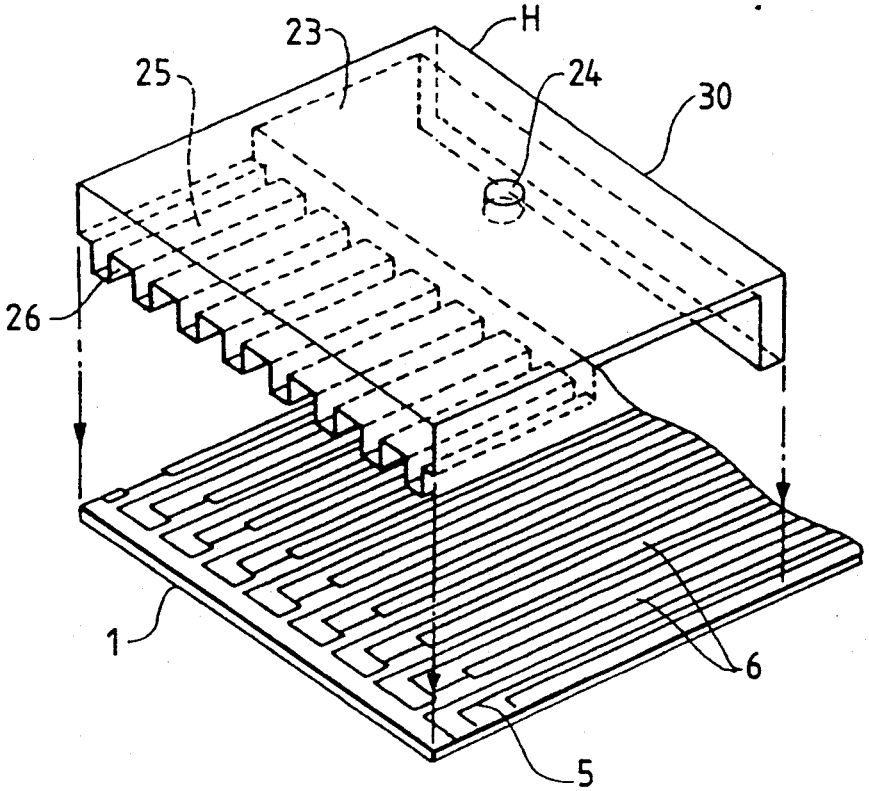
FIG. 2 is a perspective view showing an arrangement of a recording head shown in FIG. 1.
Figure 3:
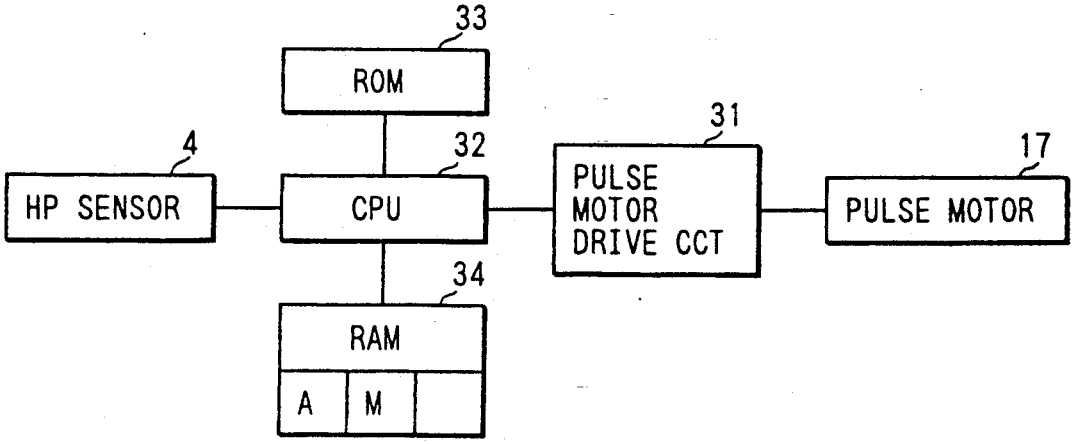
FIG. 3 is a block diagram showing a recording head drive system of the first embodiment.

FIG. 1 shows an arrangement of the first embodiment obtained when the present invention is applied to an ink-jet recording apparatus, FIG. 2 shows an arrangement of its recording head, and FIG. 3 is a block diagram showing an electrical arrangement of a recording head drive system.

Referring to FIG. 1, in the ink-jet recording apparatus, a head cartridge 14 has an integral structure consisting of a recording head H constituted by using a heater board to be described with reference to FIG. 2 later, and an ink tank serving as an ink supply source. The head cartridge 14 is fixed on a carriage 15 by a press member 41. These members can be reciprocated along shafts 21 along their longitudinal direction. An ink ejected from the recording head reaches a recording medium 18, whose recording surface is regulated by a platen 19, through a small gap formed with the recording head H, thereby forming an image on the recording medium 18.

An ejection signal corresponding to image data is supplied from an appropriate data supply source to the recording head H through a cable 16 and a terminal connected to it. At least one head cartridge (two in the illustrated embodiment) can be arranged in accordance with the number of ink colors.

Referring to FIG. 1, the ink-jet recording apparatus also includes a pulse motor 17 for scanning the carriage 15 along the shafts 21, and a wire 22 for transmitting a driving force of the motor 17 to the carriage 15. This apparatus further includes a feed motor 20, connected to a platen roller 19, for feeding the recording medium 18, and an HP (home position) sensor 4 for detecting the home position of the carriage 15. The HP sensor 4 is turned off when the carriage 15 is located in a positive direction with respect to the HP sensor 4.

FIG. 2 shows an arrangement of the recording head H. A heater board 1 comprises an electro-thermal conversion unit (ejection heater) 5 formed on a silicon substrate and a wiring 6 made of Al or the like to supply power to the electro-thermal conversion unit in accordance with film formation techniques. A ceiling plate 30 having partition walls for defining liquid paths (nozzles) 25 for a recording liquid is adhered to the heater board 1 to constitute the ink-jet type recording head H.

A recording liquid (ink) is supplied to a common liquid chamber from a supply port 24 formed in the ceiling plate 30 and is supplied to each nozzle 25. When the heater 5 is heated upon its energization, a bubbling phenomenon occurs in the ink filled in the nozzles 25. An ink droplet is ejected from each ejection port 26 upon growth and contraction of the bubble.

As shown in FIG. 3, a pulse motor drive circuit 31 drives the pulse motor 17. A CPU 32 supplies a control signal to the pulse motor drive circuit 31 to drive the pulse motor 17, as will be described later. A ROM 33 stores a control sequence (to be described later) of the CPU 32. A RAM 34 has a counter (to be described later) and temporary data storage areas A and M, and the like.

A correction value detection operation (preliminary scanning) of the embodiment having the above arrangement will be described with reference to a flow chart of FIG. 4 and a recording head movement diagram shown in FIG. 5.

Figure 5:
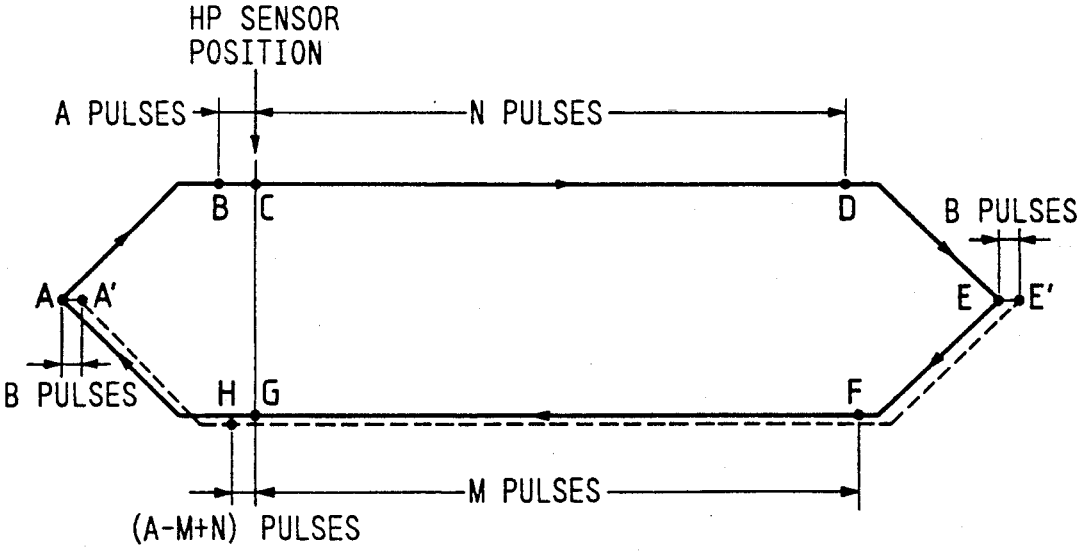
FIG. 5 is a view showing the correction value detection operation of the first embodiment.
Figure 4:
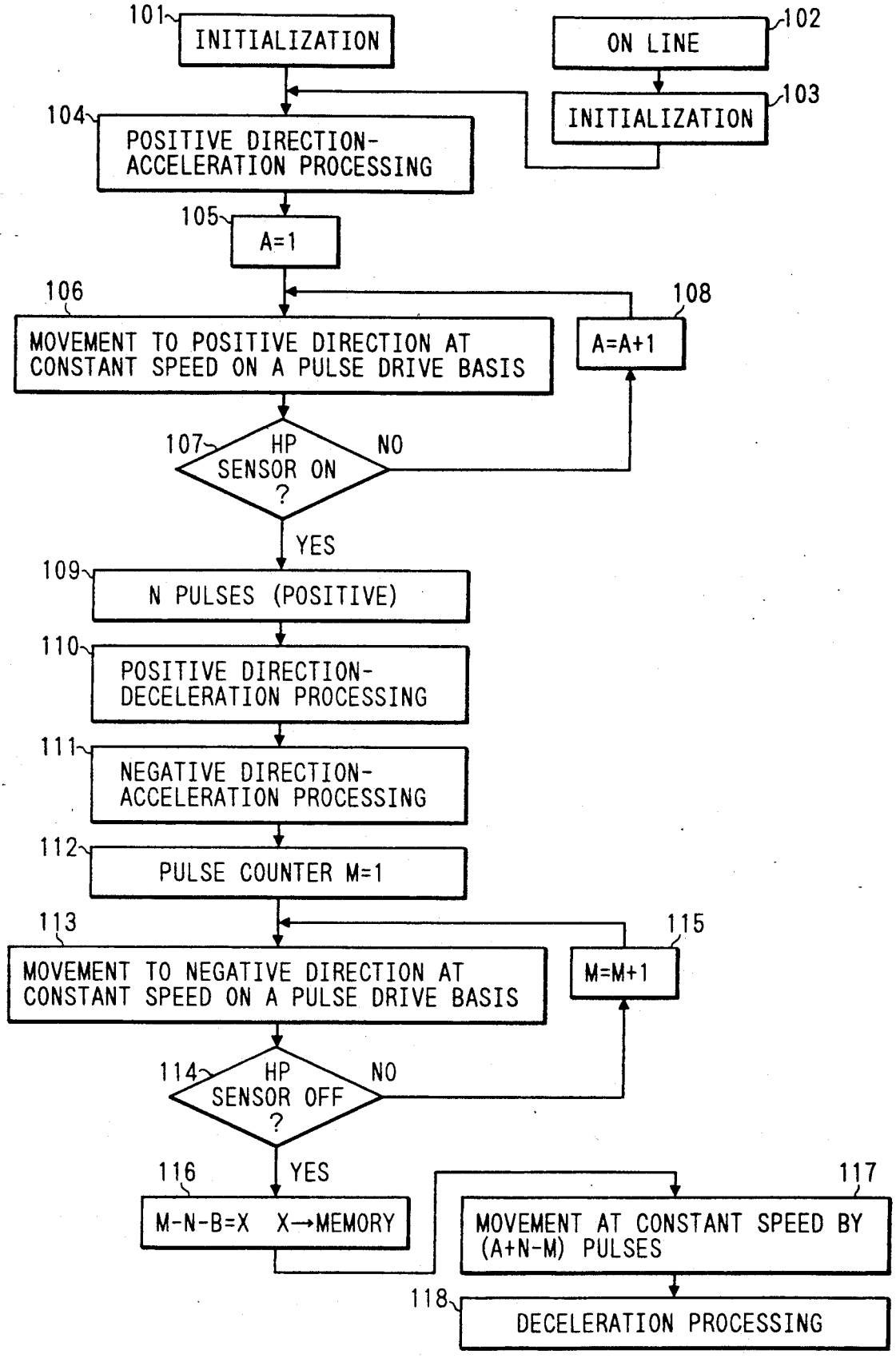
FIG. 4 is a flow chart showing a correction value detection operation of the first embodiment.

As shown in FIG. 4, initialization (101) is performed upon a power-on operation, and then direction-acceleration processing (102) is performed in which the pulse motor 17 is driven to drive the carriage 15 (recording head H) in a positive direction at a speed equal to acceleration in the recording mode (point A to point B in FIG. 5).

The counter A in the RAM 34 is set at "1" (105). Every time the recording head H is moved by one pulse at a constant speed (106), the level of the HP sensor 4 is detected (107). When the HP sensor 4 is not ON, the counter A is incremented by one (108). When the HP sensor 4 is turned on (point C in FIG. 5), the head H is moved by an arbitrary number of pulses N (109) (point D in FIG. 5). At this time, the counter A retains pulses between points B and C. Thereafter, positive direction-deceleration processing is performed (110), and movement of the recording head H is stopped (point E in FIG. 5).

Negative direction-acceleration processing (111) in which the pulse motor 17 is driven in a reverse or negative direction by the same number of pulses as in positive direction-acceleration processing is performed (point E to point F in FIG. 5). The counter M different from the counter A in the RAM 34 is set at "1" (112). Every time the recording head H is moved by one pulse (113), the level of the HP sensor 4 is detected (114). If the HP sensor 4 is not set in the OFF state, the counter M is incremented by one (115).

When the HP sensor 4 is set in the OFF state (point H in FIG. 5), the counter M has the number of pulses between points F and H. At this time, the number of pulses applied to the pulse motor 17 must be equal to that of pulses in an ideal drive system, i.e., $M=N$. However, since movement of the recording head H does not immediately correspond to the number of pulses applied to the pulse motor, a switching position error of the HP sensor 4 occurs, and $M>N$ is obtained. In addition, this error varies in accordance with a change in weight of an ink tank of the recording head H, i.e., a change in drive load over time.

In practice, the drive system is not an ideal rigid member and has some play, and has error factors such as the hysteresis of the HP sensor 4 and a circuit delay. These error factors are assigned a characteristic value B, and an error amount is stored in the RAM 34 as $X=M-N-B$ (116). In order to adjust the positive or negative movement amount of the recording head H, the recording head H is moved by $(A+N-M)$ pulses (117), and deceleration processing (118) is performed by the same number of pulses as that in positive direction-acceleration processing (point A in FIG. 5A). Note that characteristics in consideration of the characteristic value B caused by the play and the like are indicated by a dotted line in FIG. 5. An error amount X with respect to the load upon power-on operation is determined as described above.

Figure 6:
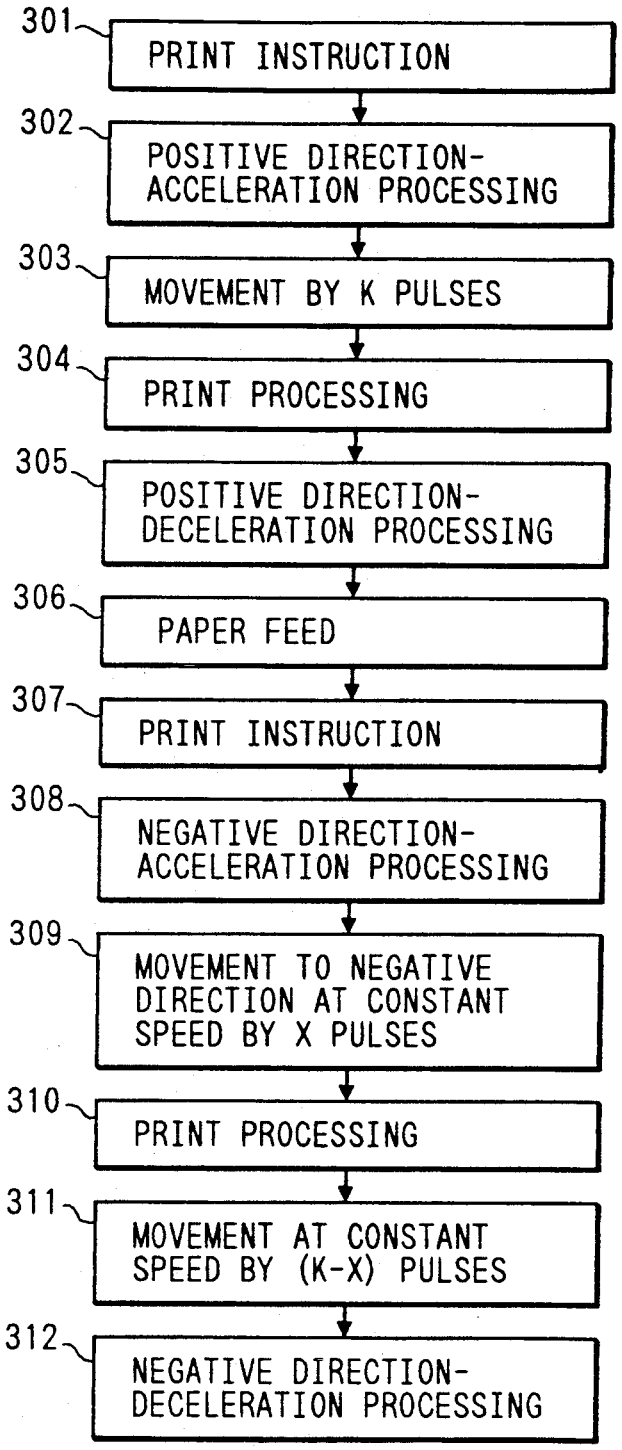
FIG. 6 is a flow chart showing a recording operation of the first embodiment.

An actual recording operation (recording scanning) will be described with reference to a flow chart in FIG. 6 and a movement diagram of the recording head in FIG. 7.

Upon reception of a recording or print instruction (301), positive direction-acceleration processing (302) is performed. In order to ensure a correction area, the recording head H is driven by K pulses (303) (point I in FIG. 7). Recording (304) is performed on the basis of data (point J in FIG. 7). Deceleration processing (305) is performed, and then the paper is fed (306).

Figure 7:
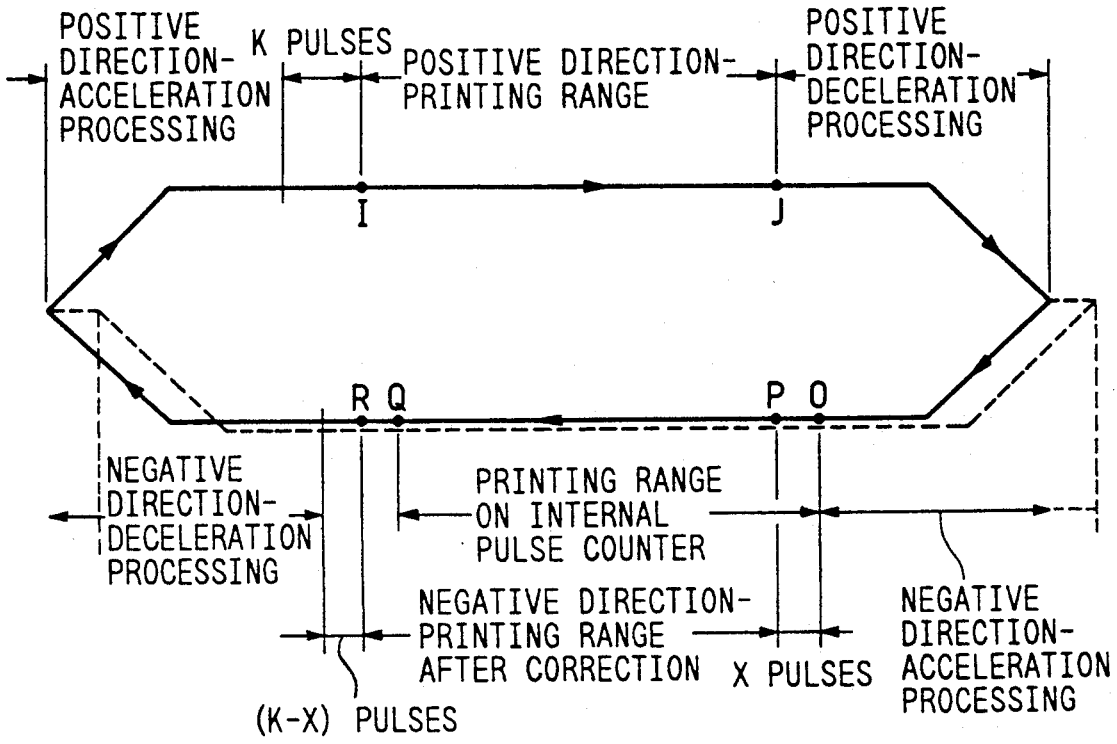
FIGS. 7 and 8 are views showing a recording operation of the first embodiment.

When the print instruction (307) of the next line is input, negative direction-acceleration processing (308) is performed (point 0 in FIG. 7), and the recording head H is moved by X correction pulses (309) (point P in FIG. 7). Data of the next line is recorded (310) (point R in FIG. 7). The recording head H is moved by (K−X) pulses (311), and deceleration processing (312) is performed.

The above operations are repeated to perform one-page recording.

FIG. 7 illustrates the above operations. The actual recording head positions are plotted along the abscissa. The point (i.e., point O) upon completion of acceleration processing in the negative direction is shifted to the right from the point (i.e., point J) of the end of printing in the positive direction. By moving the recording head H by X pulses, the printing range P–R upon completion of correct-ion almost coincides with the printing range I–J in the positive direction.

As described above, according to this embodiment, the recording head H is moved in the positive and negative directions under the same conditions as in the recording mode upon the power-on operation. The number of pulses until a moment at which the recording head H crosses the HP sensor 4 are counted, and print error correction in both directions are performed in accordance with the calculated difference. Without increasing cost or performing adjustment, print error correction with high precision in both directions can be performed. In addition, since the above correction operation is always performed upon each power-on operation, appropriate correction can be performed against variations in drive load and particularly changes in ink tank weight over time.

In addition to the difference in number of pulses, error correction in consideration of the characteristic value unique to the head drive system is performed in this embodiment. Therefore, print error correction in both directions can be performed with high precision.

In this embodiment, the positive recording area is set to be equal to the negative recording area. However, these areas may be different from each other, and printing with a minimum distance can be similarly performed.

As shown in FIG. 4, when the state is changed from an off-line state to an on-line state (102), the same control as in (104) to (118) can be performed upon initialization (103) to update correction data.

Figure 8:
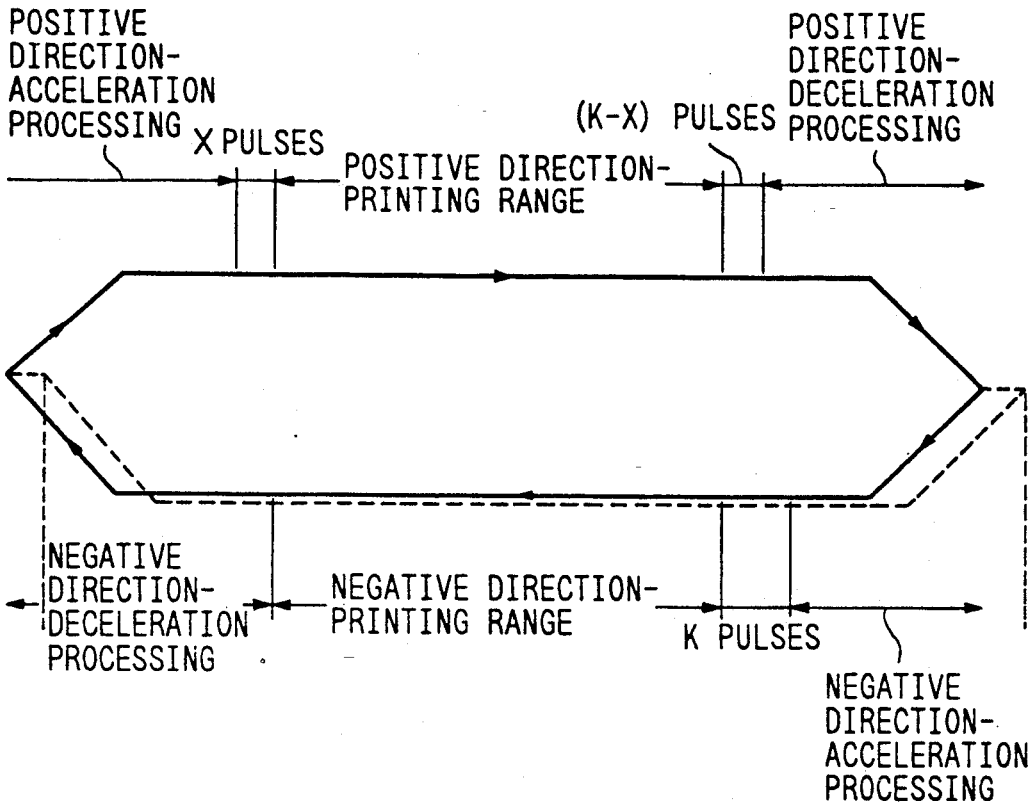

In this embodiment, correction is performed when the recording head is moved in the negative direction. However, correction may be performed when the recording head is moved in the positive direction, as shown in FIG. 8.

More specifically, after positive direction-acceleration processing is performed, the recording head is moved by the X pulses corresponding to the correction value. In this state, recording is performed, and the recording head is moved by (K−X) pulses. Thereafter, the recording head is decelerated and finally stopped. In printing in the negative direction, upon completion of acceleration processing, the recording head is moved by K pulses to ensure a correction area. Recording is then performed, and the recording head is decelerated and finally stopped. In this manner, even if the recording head is moved by pulses in the positive direction, the same effect as in the above embodiment can be obtained.

The second embodiment of the present invention will be described below.

Figure 9:
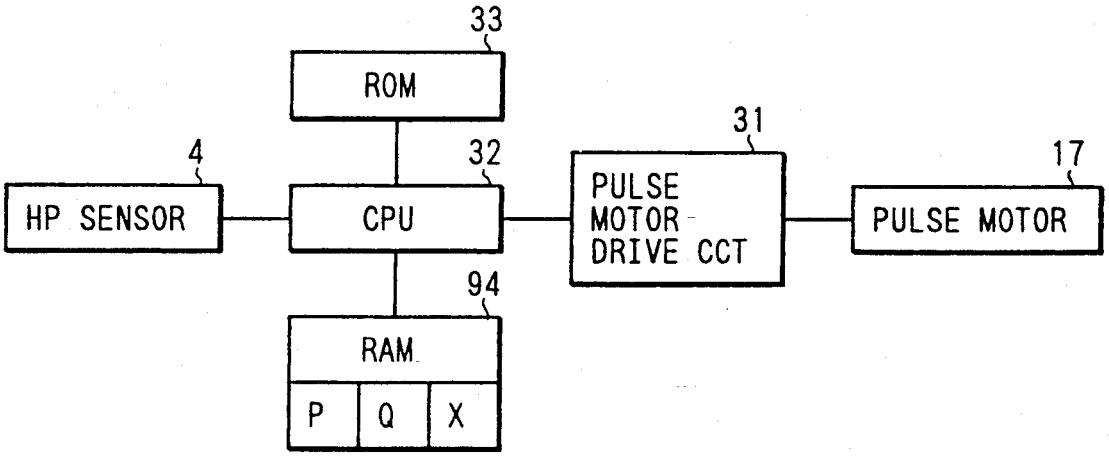
FIG. 9 is a block diagram showing a recording head drive system according to the second embodiment of the present invention.

This embodiment has the same mechanical structure as in the embodiment shown in FIG. 1, and the block diagram of an electrical arrangement of a drive system for a recording head H is shown in FIG. 9.

Referring to FIG. 9, the drive system includes a pulse motor drive circuit 31 for driving a pulse motor 17, a CPU 32 for supplying a control signal to the pulse motor drive circuit 31 to drive the pulse motor 17, as will be described later, a ROM 33 for storing a control sequence (to be described later), and a RAM 94 having counters (to be described later) or temporary data storage areas P, Q, and X, and the like.

The pulse motor 17 has a resolution per pulse corresponding to a drive amount of 1/60" of the recording head H. A print area corresponds to 480 pulses (8").

A correction value detection operation (preliminary scanning) of this embodiment will be described with reference to a flow chart in FIG. 10 and a movement diagram of the recording head shown in FIG. 11.

Figures 10, 10A:
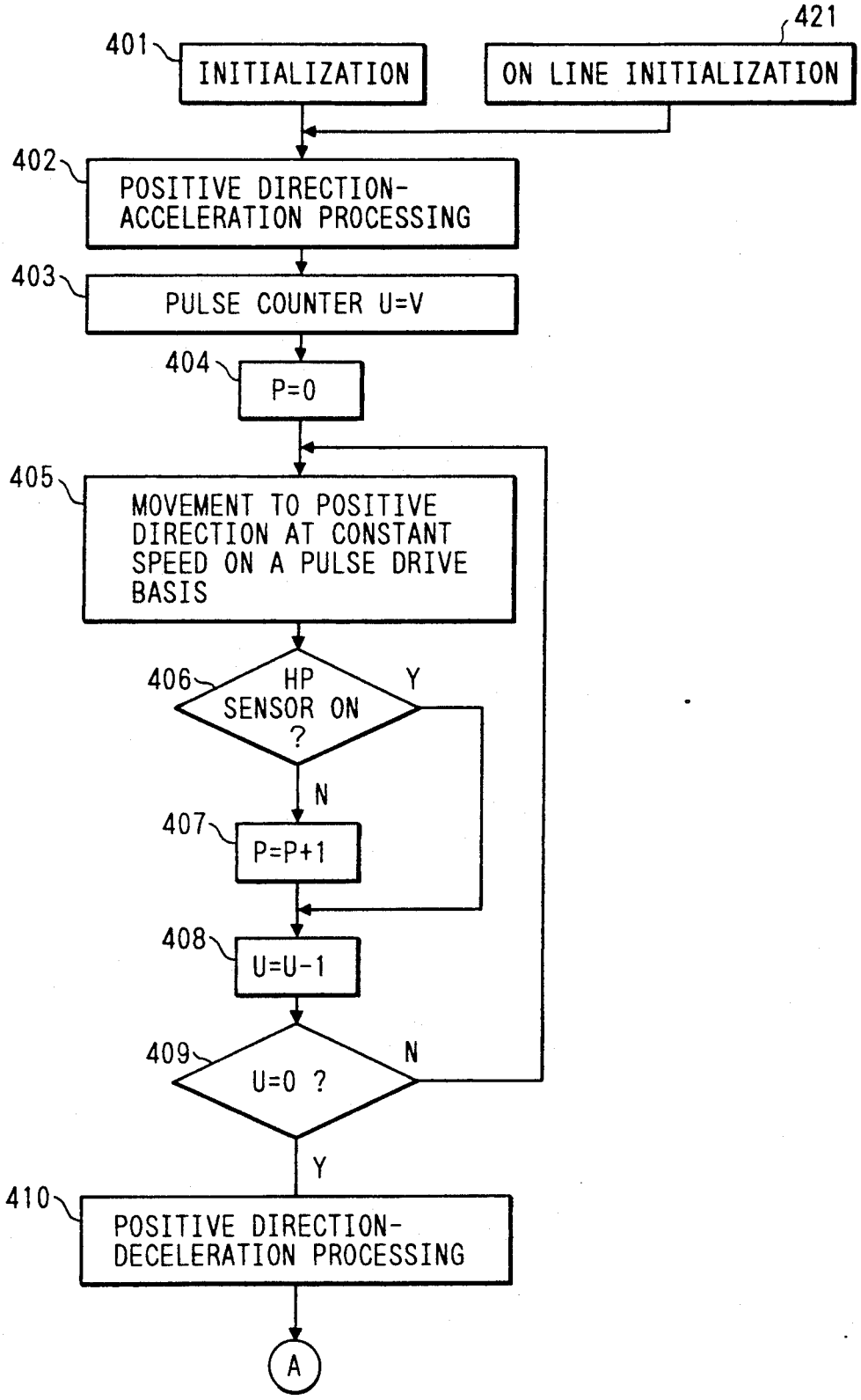
FIG. 10 is a flow chart showing a correction value detection operation according to the second embodiment of the present invention.
Figure 10B:
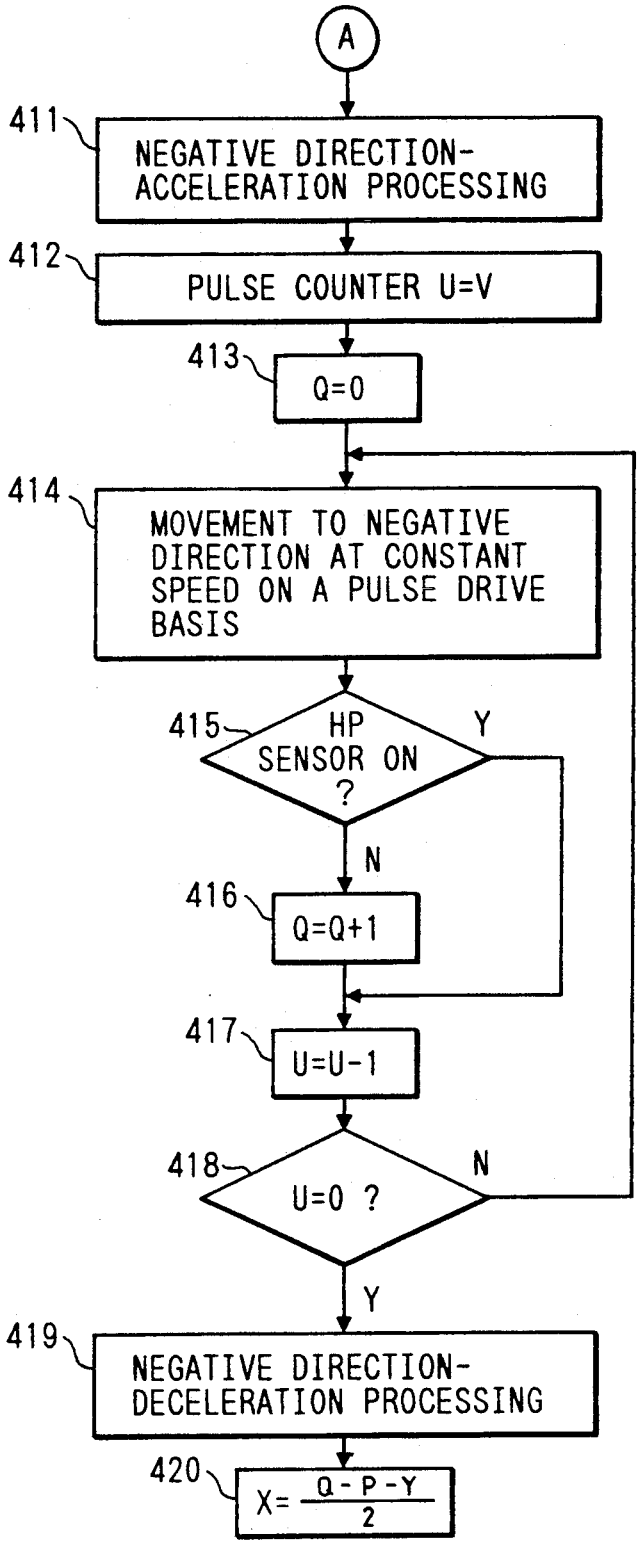
Figure 11:
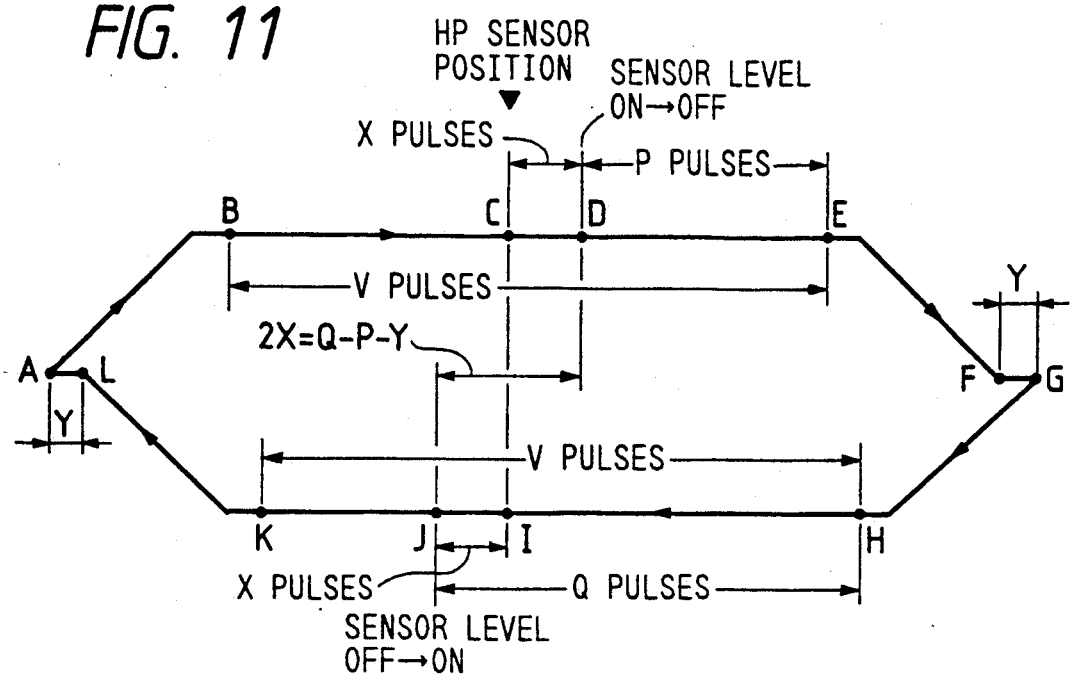
FIG. 11 is a view showing a correction value detection operation of the second embodiment.

As shown in FIG. 10, initialization (401) is performed upon power-on operation, and positive direction-acceleration processing (402; point A to point B in FIG. 11) is performed wherein the pulse motor 17 is driven to drive a carriage 15 (recording head H) in a positive direction at a speed equal to that in a recording mode.

A movement pulse count V (e.g., 160; ⅓ of 480 pulses corresponding to the print area) in the positive direction is set in a movement pulse counter U in the RAM 94 (403). In this case, the count V is a value stored in the ROM 33 and corresponding to a pulse count representing a distance up to point E sufficiently spaced apart from point B in FIG. 11, passing through an HP sensor 4. The counter P is set to be "0" (404). Every time the recording head H is moved by one pulse at a constant speed (405), the level of the HP sensor 4 is detected (406). If the HP sensor 4 is set in the OFF state, the counter P is incremented by one (407). This operation is repeated by V pulses (408 and 409). At this time, the counter P represents a pulse count from point D to point E in FIG. 11, i.e., a period during which the sensor level is changed from the ON state to the OFF state. Upon completion of movement by V pulses, positive direction-deceleration processing (410) is performed, and movement of the recording head H is stopped (points E and F in FIG. 11).

The pulse motor 17 is driven in the negative or reverse direction, and negative direction-deceleration processing (411; point G to point H in FIG. 11) is performed by the same pulse count as that in the positive direction-deceleration processing. The same value V as in positive movement is set as a movement pulse count in the negative direction in the movement pulse counter U (412). The counter Q is set to be "0" (413). Every time the recording head H is moved by one pulse at a constant speed (414), the level of the HP sensor is detected (415). When the level of the HP sensor is set in the OFF state, the counter Q is incremented by one (461). This processing is repeated by V pulses (417 and 418). At this time, the counter Q stores a pulse count from point H to point J in FIG. 11 during which the level of the sensor is changed from the OFF state to the ON state. Upon completion of movement of the recording head by V pulses, negative direction-deceleration processing is performed by the same pulse count as in the positive direction-acceleration processing (419), and movement of the recording head H is stopped (point K to point L in FIG. 11).

When the above processing is completed, condition P=Q must be obtained in an ideal drive system. In practice, however, since the drive system is not an ideal rigid body, the drive system has a characteristic value Y (points A to L and points F to G in FIG. 11) such as a play. In addition, since the recording head H cannot immediately respond to the pulses supplied to the pulse motor 17, a level inversion position of the HP sensor 4 is shifted from point C to point D in the positive direction and from point I to point J in the negative position, thereby obtaining condition Q>P. When this error value is given as X, the value X in the positive direction is regarded to be equal to that in the negative direction, so that the error value can be calculated by X=(Q−P−Y/Z. This value is stored in the RAM 94 as a correction value (420). The error amount X for the load upon the power-on operation can thus be obtained.

In this embodiment, since P=145, Q=150, and Y=1, then X=2. Alternatively, the above operations are repeated a plurality of times to obtain a plurality of correction values, an average value of the plurality of correction values is calculated, and the average value may be stored in the RAM 94 as a correction value.

A correction sequence (recording scanning) during actual recording will be described with reference to a flow chart in FIG. 12 and a recording head movement chart shown in FIG. 13.

Figure 13:
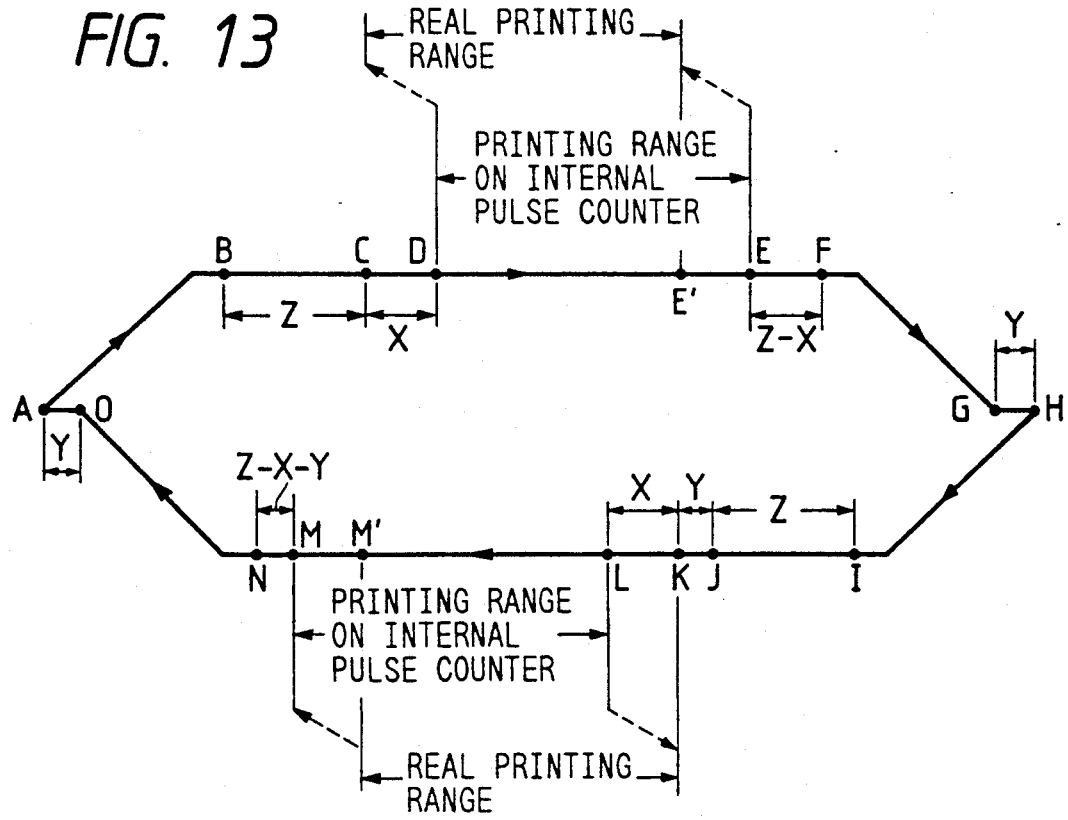
FIG. 13 is a view showing a correction value detection operation of the second embodiment.
Figure 12:
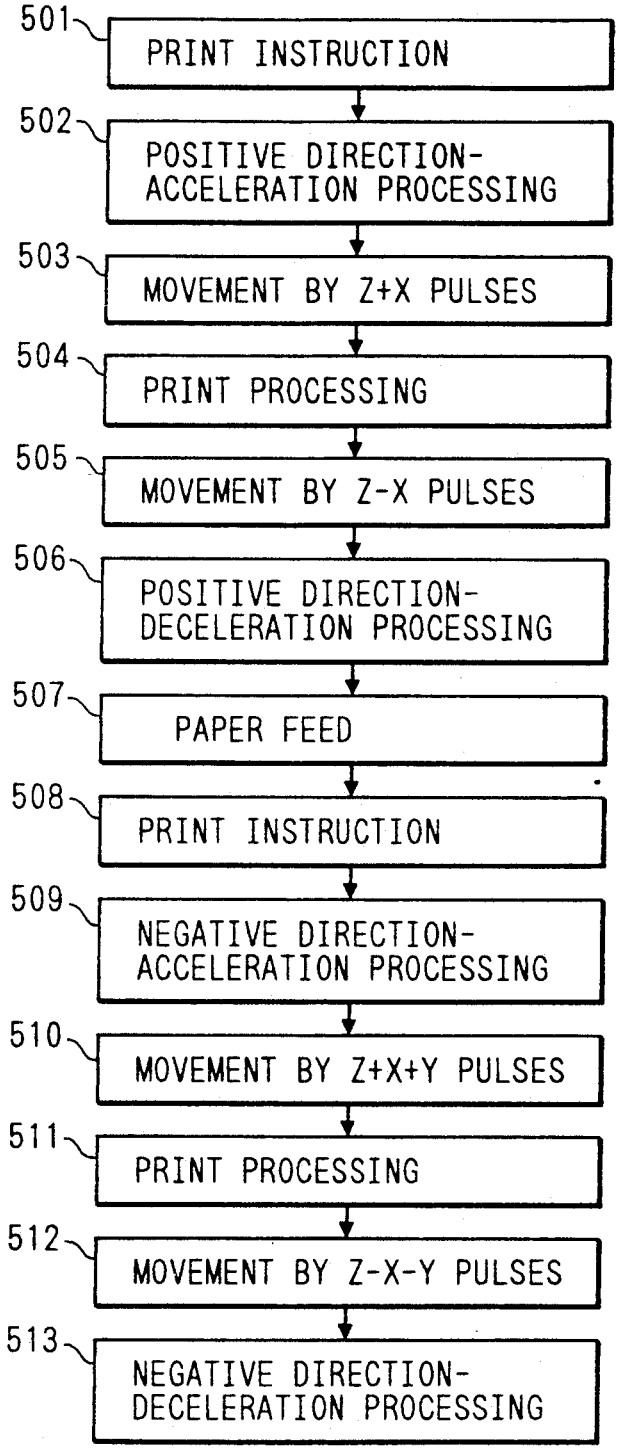
FIG. 12 is a flow chart showing a recording operation of the second embodiment.

During actual recording, as shown in FIG. 12, upon reception of a print instruction (501), positive direction-acceleration processing is performed (502; point A to point B in FIG. 13). The recording head is moved by Z pulses to obtain an area for ensuring a correction area, and the recording head is moved by the correction value corresponding to X pulses (503; from point B to points C and D in FIG. 13). At this time, the area Z is set to have a larger value than a sum of a maximum value of the assumed correction value X and the characteristic value Y caused by a play.

Recording is then performed in accordance with recording data (504; point D to point E in FIG. 13), and the recording head is moved by (Z−X) pulses to adjust the correction area upon recording (505; point E to point F in FIG. 13). After positive direction-deceleration processing is performed (506; point F to point G in FIG. 13), the paper is fed (507).

When a print instruction of the next line is received (508), negative direction-acceleration processing is performed by the same pulse count as in the positive direction-deceleration processing (509; point H to point I in FIG. 13). The recording head is moved by Z pulses to obtain an area for assuring the correction area, and then the recording head is moved by Y pulses as the characteristic value Y caused by a play and the like. In addition, the recording head is moved by X pulses as the correction value (510; from point I to points J, K, and L in FIG. 13).

Recording is then performed in accordance with recording data (511; point L to point M in FIG. 13). In order to adjust the correction area upon recording, the recording head is moved by (Z−X−Y) pulses (505; point M to point N in FIG. 13). Negative direction-deceleration processing is performed by the same pulse count as in the positive direction-acceleration processing (513).

The above operations are repeated to perform one-page recording.

FIG. 13 illustrates the positions of the recording heads H in the above operations. This processing is performed so that the printing range in the positive direction falls between point D and point E, and that in the negative direction falls between point M and point L. In practice, however, an error corresponding to X occurs as in detection of the correction value. The printing range in the positive direction falls between point C and point E′, and that in the negative direction falls between point M′ and point K.

An actual print start position can be kept to be point C even if the correction value X upon detection is changed by load variations such as differences between apparatuses and deteriorations over time. This is because error correction is performed in both the positive and negative directions.

In this embodiment, the positive recording area is set to be equal to that of the negative recording area. However, the positive recording area may be different in size from the negative recording area, and printing with a minimum distance can be performed.

When the off-line state is changed to the on-line state, as shown in FIGS. 10 (421, 402 to 420), the same control as described above can be performed to update the correction value. In addition to the case wherein the apparatus is powered on, or is changed from the off-line state to the on-line state, the correction value calculation control described above can be performed prior to recording.

In this embodiment, the pulse count (i.e., a switching count of excitation phases) of the pulse motor 17 is counted. However, when ink ejection (dot) is performed at timings each obtained by dividing (e.g., six divisions) one phase of the pulse, the number of dots may be counted. In this case, error correction precision can be given as 1/360″, thereby further improving error correction precision.

In a recording apparatus having a plurality of print speeds, correction values X1, X2, . . . corresponding to the respective speeds are obtained, thereby performing optimal error correction at the respective speeds.

The present invention is not limited to a pulse motor as a drive source for the recording head (carriage), but can employ, e.g., a DC motor.

The HP sensor can be arranged outside the acceleration or deceleration processing area.

A preliminary scanning amount is not limited to a specific value. However, in consideration of preliminary scanning time and precision, this amount is preferably set to be ½ to ¼, particularly ⅓, of the recording width.

The present invention can equally be applied to, e.g., a thermal transfer recording system using a thermal head, a heat-sensitive recording system, and an impact recording system using a daisy wheel, a wire dot, or the like. When the ink-jet recording system is employed, an excellent effect can be obtained in the ink-jet recording apparatus utilizing heat energy, as described in the above embodiments. According to this system, high-density, high-precision recording can be performed.

As to its representative constitution and principle, for example, one practiced by use of the basic principle disclosed in, for example, U.S. Pat. Nos. 4,723,129 and 4,740,796 is preferred. This system is applicable to either of the so called on-demand type and the continuous type of ink jet recording. Particularly, the case of the on-demand type is effective because, by applying at least one driving signal which gives rapid temperature elevation exceeding nucleate boiling corresponding to the recording information on electricity-heat converters arranged corresponding to the sheets or liquid channels holding liquid (ink), heat energy is generated at the electricity-heat converters to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble, at least one droplet is formed. By making the driving signals into pulse shapes, growth and shrinkage of the bubble can be effected instantly and adequately to accomplish more preferably discharging of the liquid (ink) particularly excellent in response characteristic. As the driving signals of such pulse shape, those as disclosed in U.S. Pat. Nos. 4,463,359 and 4,345,262 are suitable. Further excellent recording can be performed by employment of conditions described in U.S. Pat. No. 4,313,124 of the invention concerning the temperature elevation rate of the above-mentioned heat acting surface.

As the constitution of the recording head, in addition to the combination constitutions of discharging orifice, liquid channel, electricity-heat converter (linear liquid channel or right angle liquid channel) as disclosed in the above mentioned respective specifications, the constitution by use of U.S. Pat. Nos. 4,558,333, 4,459,600 disclosing the constitution having the heat acting portion arranged in the flexed region is also included in the present invention. In addition, the present invention can be also effectively made the constitution as disclosed in Japanese Patent Laid-Open Application No. 59-123670 which discloses the constitution using a slit common to a plurality of electricity-heat converters as the discharging portion of the electricity-heat converter or Japanese Patent Laid-Open Application No. 59-138461 which discloses the constitution having the opening for absorbing pressure waves of heat energy correspondent to the discharging portion.

Further, as the recording head of the full line type having a length corresponding to the maximum width of recording medium which can be recorded by the recording device, either the constitution which satisfies its length by combination of a plurality of recording heads as disclosed in the above-mentioned specifications or the constitution as one recording head integrally formed may be used, and the present invention can exhibit the effects as described above further effectively.

In addition, the present invention is effective for a recording head of the freely exchangeable chip type which enables electrical connection to the main device or supply of ink from the main device by being mounted on the main device, or for the case by use of a recording head of the cartridge type provided integrally on the recording head itself.

Also, addition of a restoration means for the recording head, a preliminary auxiliary means, etc. provided as the constitution of the recording device of the present invention is preferable, because the effect of the present invention can be further stabilized. Specific examples of these may include, for the recording head, capping means, cleaning means, pressurization or aspiration means, electricity-heat converters or another heating element or preliminary heating means according to a combination of these, and it is also effective for performing stable recording to perform preliminary mode which performs discharging separate from recording.

Further, as the recording mode of the recording device, the present invention is extremely effective for not only the recording mode using only a primary color such as black etc., but also the recording mode using at least one of plural different colors or full color by color mixing, whether the recording head is integrally constituted or combined in plural number.

In each embodiment described above, the ink is exemplified as a liquid. However, an ink which is solidified at room temperature or less is generally temperature-controlled to be softened or liquefied at room temperature or in a temperature range of 30° C. to 70° C., thereby controlling the viscosity of the ink to fall within a stable ejection range. For this reason, an ink need only be in a liquid phase when a recording signal is applied. Alternatively, by using an ink which positively prevents temperature increase from heat energy by using the heat energy for changing a state from a solid phase to a liquid phase of the ink, or by using an ink which is solidified in an exposed state for the purpose of evaporation prevention, heat energy is applied to the ink in accordance with a recording signal, and the liquefied ink is ejected. An ink which starts solidifying before it reaches the surface of a recording medium may also be used. That is, an ink which is liquefied only upon application of heat energy may be used in the present invention. In addition, as described in Japanese Patent Laid-Open Application No. 54-56874 or 60-71260, an ink as a liquid or solid body stored in a recess or through hole of a porous sheet may be opposed to a electricity-heat converter. According to the present invention, a most effective method for each ink is a film boiling method.

In addition, the ink-jet recording apparatus according to the present invention can be used in an image output terminal of data processing equipment such as a computer, a copying apparatus in combination with a reader and the like, and a facsimile apparatus having transmission and reception functions.

Figure 14:
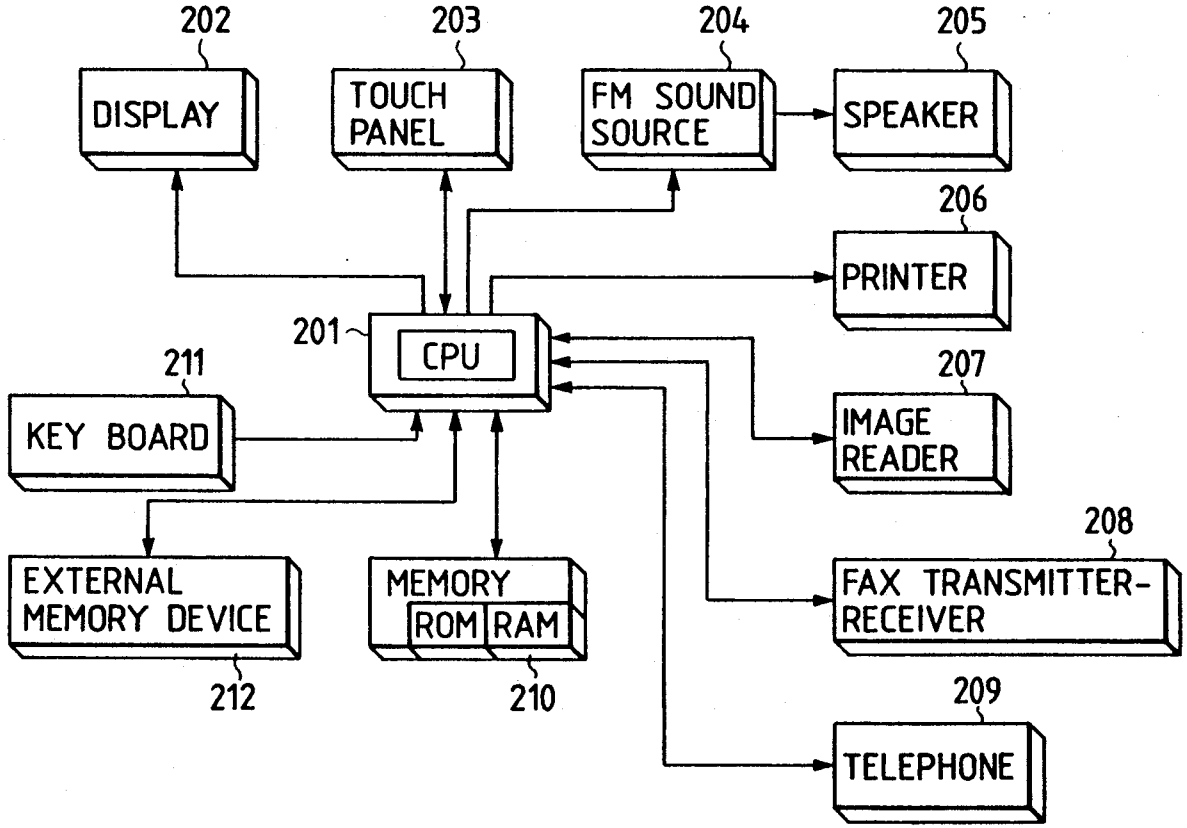
FIG. 14 is a schematic block diagram showing an arrangement obtained when the present invention is applied to a data processing apparatus.

FIG. 14 is a schematic block diagram in which a recording apparatus of the present invention is applied to a data processing apparatus having functions as a wordprocessor, a personal computer, a facsimile apparatus, and a copying apparatus.

A controller 201 controls the overall operation of the apparatus and includes a CPU (e.g., a microprocessor) and has various I/O ports. The controller 201 outputs control and data signals to the respective circuit components or receives control and data signals from these components. A display 202 displays various menus, document information, and image data read by an image reader 207 on the display screen. A transparent pressure-sensitive touch panel 203 is arranged on the display 202. When the surface of the touch panel 203 is pressed with a finger or the like, a desired item or a coordinate position can be input on the display 202.

An FM (Frequency Modulation) sound source 204 stores music information generated by a music editor or the like in a memory 210 or an external memory device 212 in the form of digital data, reads out stored data from the memory and the like, and performs FM modulation of the readout data. An electrical signal from the FM sound source 204 can be produced as sounds from a speaker 205. A printer 206 is constituted by the recording apparatus of the present invention as an output terminal for a wordprocessor, a personal computer, a facsimile apparatus, and a copying machine.

The image reader 207 photoelectrically reads original data and inputs the read data. The image reader 207 is arranged in an original convey path and reads a facsimile original, a copying original, and various other originals. A FAX transmitter-receiver 208 performs facsimile transmission of original data read by the image reader 207, receives a transmitted facsimile signal, and decodes the received facsimile signal. The FAX transmitter-receiver 208 has an interface function with an external device. A telephone 209 has various telephone functions such as normal telephone functions and automatic telephone answering functions.

The memory 210 includes a ROM for storing a system program, a manager program, other application programs, character fonts, and a dictionary, and a video RAM, and further stores application programs loaded from the external memory device 212 and document information.

A keyboard 211 is used to input document information and various commands.

The external memory device 212 uses a memory medium such as a floppy or hard disk. Document information, music or voice information, and user application programs are stored in the external memory device 212.

Figure 15:
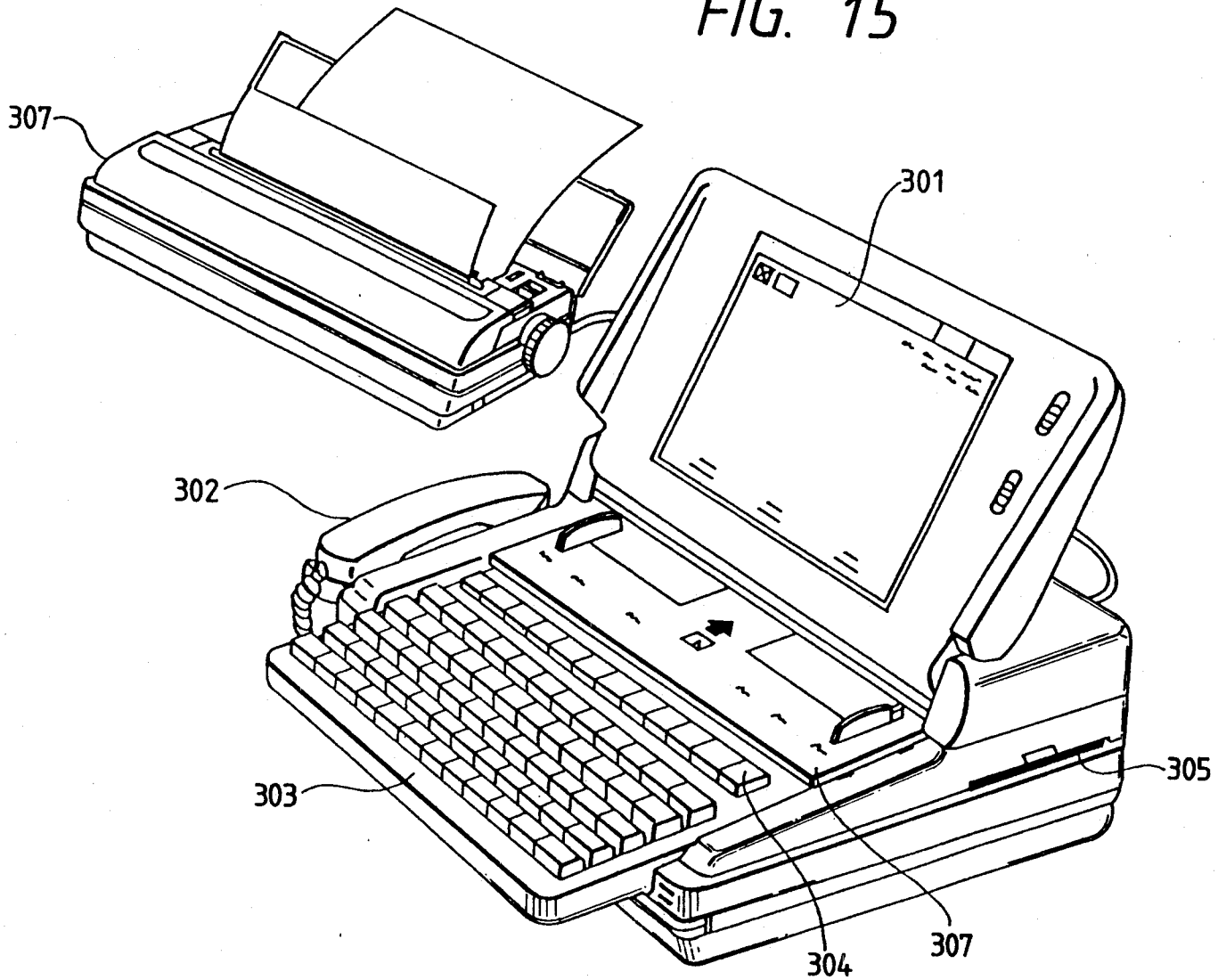
FIGS. 15 and 16 are perspective views of the data processing apparatus shown in FIG. 14.

FIG. 15 is an external perspective view of the data processing apparatus shown in FIG. 14.

A flag display panel 301 is obtained by using a liquid crystal or the like and displays various menus, graphic data, and document data. The touch panel 203 is formed on the display 301. Upon depression of the surface of the touch panel 203 with a finger or the like, coordinate data or an item can be input. A handset 302 is used when the apparatus serves as a telephone. A keyboard 303 is detachably connected to the main body through a cord and is used to input various document data and other data. The keyboard 303 has various function keys 304. A floppy disk slot 305 is formed in the main body for accessing data from the external memory device 212.

An original is placed on an original table 306 and is read by the image reader 207. The read original is discharged from the rear portion of the apparatus. In a facsimile reception mode or the like, the received data is recorded at an ink-jet printer 307.

The display 202 may be constituted by a CRT display. However, a flat panel such as a liquid crystal display utilizing a ferromagnetic liquid crystal is preferred to obtain a compact, low-profile, lightweight display.

When the data processing apparatus is used as a personal computer or a wordprocessor, various data input from the keyboard 211 is processed by the controller 201 in accordance with a predetermined program. The processed data is output as an image at the printer 206.

When the apparatus serves as a receiver of the facsimile apparatus, facsimile data input from the FAX transmitter-receiver 208 through a communication line is received and processed by the controller 201 in accordance with a predetermined program. The processed data is output as a reception image at the printer 206.

When the apparatus serves as a copying machine, an original is read by the image reader 207, and the read original data is output as a copy image at the printer 206 through the controller 201. When the apparatus serves as a transmitter of the facsimile apparatus, original data read by the image reader 207 is transmitted by the controller 201 in accordance with a predetermined program The processed data is sent to the transmission line through the FAX transmitter-receiver 208.

Figure 16:
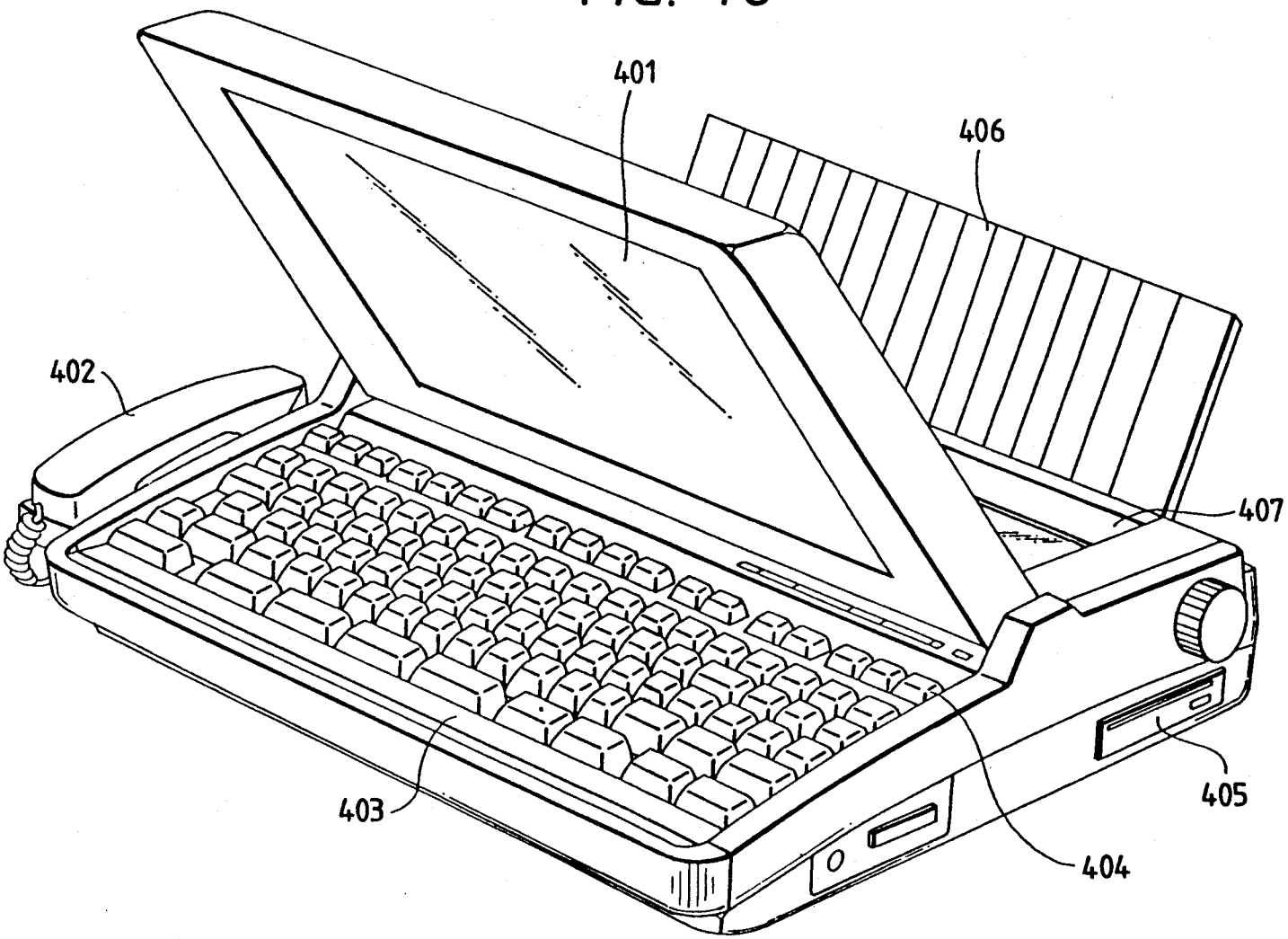

The data processing apparatus may be an integral unit including an ink-jet printer, as shown in FIG. 16. In this case, a more portable apparatus can be obtained. The same reference numerals as in FIG. 15 denote the same parts in FIG. 16.

As described above, the recording apparatus of the present invention is applied to the multifunctional data processing apparatus as described above to obtain a high-quality recorded image with low noise at high speed, thereby further improving the functions of the data processing apparatus.

As has been described above, according to the present invention, the positions of the recording head in the positive and negative directions can be accurately controlled regardless of drive load variations.

What is claimed is:

1. A serial recording apparatus for reciprocating a recording head with respect to a recording medium to perform bidirectional recording, said apparatus comprising:

position detecting means for detecting a reference position of said recording head;

driving means for reciprocating said recording head within a predetermined area including the reference position, the predetermined area being within a range from $\frac{1}{4}$ to $\frac{1}{2}$ of a recording area;

means for calculating a difference between reference positions detected by said position detecting means by reciprocal movement when said recording head is reciprocated by said driving means within the predetermined area; and means for correcting a positional error in bidirectional recording on a basis of the difference calculated by said calculating means.

2. An apparatus according to claim 1, wherein said correcting means corrects the positional error on the basis of the difference calculated by said calculating means and a characteristic value of said driving means.

3. An apparatus according to claim 2, wherein the characteristic value of said driving means is based at least in part on play of said driving means.

4. An apparatus according to claim 2, wherein said driving means comprises circuitry and the characteristic value of said driving means is based at least in part on a delay in said circuitry of said driving means.

5. An apparatus according to claim 1, wherein said correcting means corrects the positional error on the basis of the difference calculated by said calculating means and a characteristic value based at least in part on a hysteresis of said position detecting means.

6. An apparatus according to claim 1, wherein said correcting means corrects the positional error while said recording head is moved for recording in one direction or the other direction.

7. An apparatus according to claim 1, wherein said correcting means corrects the positional error during movement of said recording head for recording in both directions.

8. An apparatus according to claim 1, wherein said driving means includes a pulse motor, and said calculating means calculates the difference between the detected reference positions by a number of pulses for driving said pulse motor.

9. An apparatus according to claim 1, wherein said driving means includes a pulse motor, and said calculating means calculates the difference between the detected reference positions in accordance with a plurality of phases obtained by dividing a pulse for driving said pulse motor.

10. An apparatus according to claim 1, wherein said driving means drives to reciprocate said recording head to cause said calculating means to calculate the difference between the detected reference positions upon a power-on operation.

11. An apparatus according to claim 1, wherein said driving means drives to reciprocate said recording head to cause said calculating means to calculate the difference between the detected reference positions in an on-line mode.

12. An apparatus according to claim 1, wherein said calculating means calculates the differences between the detected reference positions at a plurality of speeds.

13. An apparatus according to claim 1, wherein the predetermined area is about ⅓ the recording area.

14. An apparatus according to claim 1, wherein said recording head comprises an ink-jet recording head for ejecting ink droplets to perform recording.

15. An apparatus according to claim 1, wherein said recording head comprises an ink jet recording head for ejecting ink droplets to perform recording upon growth and shrinkage of bubbles.

16. An apparatus according to claim 1, wherein said recording head comprises a plurality of ejection ports for ejecting ink, and heat energy generating means, respectively arranged in correspondence with said plurality of ejection ports, for causing a change in state in the ink by heat and ejecting the ink from said ejection ports to form flying liquid droplets on the basis of the change in state.

17. An apparatus according to claim 1, wherein said recording head is interchangeable with respect to said serial recording apparatus.

18. An apparatus according to claim 17, wherein said recording head comprises an ink-jet recording head for ejecting ink droplets to perform recording.

19. An apparatus according to claim 18, wherein said recording head comprises a tank for storing ink.

20. An apparatus according to claim 1, further comprising computing means for computing and recording various information inputted through an input device.

21. An apparatus according to claim 1, wherein said serial recording apparatus has a facsimile function which records facsimile information received through a communication line.

22. An apparatus according to claim 1, wherein said serial recording apparatus has a word processing function which records various information inputted through a keyboard.

23. An apparatus according to claim 1, wherein said serial recording apparatus has a copier function which records read original information.

24. A serial recording method of reciprocating a recording head with respect to a recording medium to perform bidirectional recording, said method comprising the steps of:

reciprocating said recording head within a predetermined area including a reference position prior to recording, the predetermined area being within a range from ¼ to ½ of a recording area;

detecting reference positions in both directions during reciprocal movement and calculating a difference between the detected reference positions; and correcting a positional error to perform bidirectional recording on a basis of the calculated difference.

25. A method according to claim 24, wherein said step of performing bidirectional recording comprises the step of correcting the positional error while said recording head performs recording in one direction or the other direction.

26. A method according to claim 24, wherein said step of performing bidirectional recording comprises the step of correcting the positional error during recording of said recording head in both directions.

27. A method according to claim 24, wherein the predetermined area is about ⅓ the recording area.

28. A method according to claim 24, wherein said recording head comprises an ink-jet recording head for ejecting ink droplets to perform recording.

29. A method according to claim 24, wherein said recording head comprises an ink jet recording head for ejecting ink droplets to perform recording upon growth and shrinkage of bubbles.

30. A method according to claim 24, wherein said recording head comprises a plurality of ejection ports for ejecting ink, and heat energy generating means, respectively arranged in correspondence with said plurality of ejection ports, for causing a change in state in the ink by heat and ejecting the ink from said ejection pots to form flying liquid droplets on the basis of the change in state.

31. A method according to claim 24, wherein said recording head is interchangeable with respect to a serial recording apparatus.

32. A method according to claim 31, wherein said recording head comprises an ink-jet recording head for ejecting ink droplets to perform recording.

33. A method according to claim 32, wherein said recording head comprises a tank for storing ink.

34. A serial recording apparatus for reciprocating a recording head with respect to a recording medium to perform bidirectional recording, said apparatus comprising:

position detecting means for detecting a passage of a reference position by said recording head;

driving means for reciprocating said recording head within a predetermined area of a recording area including the reference position;

means for calculating a difference in timing between passages of reference positions detected by said position detecting means of movements in both directions, respectively, when said recording head is reciprocated by said driving means within the predetermined area; and means for correcting a positional error in bidirectional recording on a basis of a difference calculated by said calculating means and a characteristic value of said driving means.

35. An apparatus according to claim 34, wherein the characteristic value of said driving means is based at least in part on play of said driving means.

36. An apparatus according to claim 34, wherein said driving means comprises circuitry and the characteristic value of said driving means is based at least in part on a delay in said circuitry of said driving means.

37. An apparatus according to claim 34, wherein said correcting means corrects the positional error on a further basis of another characteristic value based on a hysteresis of said position detecting means.

38. An apparatus according to claim 34, wherein said correcting means corrects the positional error while said recording head is moved for recording in one direction or the other direction.

39. An apparatus according to claim 34, wherein said correcting means corrects the positional error during movement of said recording head for recording in both directions.

40. An apparatus according to claim 34, wherein said driving means includes a pulse motor, and said calculating means calculates the difference between the detected reference positions in accordance with a plurality of phases obtained by dividing a pulse for driving said pulse motor.

41. An apparatus according to claim 34, wherein said driving means drives to reciprocate said recording head to cause said calculating means to calculate the difference between the detected reference positions upon a power-on operation.

42. An apparatus according to claim 34, wherein said driving means drives to reciprocate said recording head to cause said calculating means to calculate the difference between the detected reference positions in an on-line mode.

43. An apparatus according to claim 34, wherein the predetermined area is about ⅓ the recording area.

44. An apparatus according to claim 34, wherein said recording head comprises a plurality of ejection ports for ejecting ink, and heat energy generating means, respectively arranged in correspondence with said plurality of ejection ports, for causing a change in state in the ink by heat and ejecting the ink from said ejection ports to form flying liquid droplets on the basis of the change in state.

45. An apparatus according to claim 34, wherein said recording head is interchangeable with respect to said serial recording apparatus.

46. An apparatus according to claim 34, wherein said serial recording apparatus has a facsimile function which records facsimile information received through a communication line.

47. An apparatus according to claim 34, wherein said serial recording apparatus has a word processing function which records various information inputted through a keyboard.

48. An apparatus according to claim 34, wherein said serial recording apparatus has a copier function which records read original information.

49. An apparatus according to claim 34, further comprising computing means for computing and recording various information inputted through an input device.

50. A serial recording method of reciprocating a recording head with respect to a recording medium to perform bidirectional recording, said method comprising the steps of:

providing a recording head driving system to reciprocate said recording head;

reciprocating said recording head within a predetermined are of a recording are including a reference position prior to recording;

detecting reference positions of movements in both directions, respectively, during reciprocal movement and calculating a difference in timing of the detection of the reference positions; and correcting a positional error in order to perform bidirectional recording on a basis of the calculated difference and a characteristic value of the driving system.

51. A method according to claim 51, wherein the characteristic value of the driving system is based at least in part on play of the driving system.

52. A method according to claim 50, wherein the driving system comprises circuitry and the characteristic value of the driving system is based at least in part on a delay in the circuitry of the driving system.

53. A method according to claim 50, wherein said step of correcting a positional error is effected on a further basis of another characteristic value based at least in part on a hysteresis of a detector for detecting the reference position.

54. A method according to claim 50, wherein said step of performing bidirectional recording comprises the step of correcting the positional error while said recording head performs recording in one direction or the other direction.

55. A method according to claim 50, wherein said step of performing bidirectional recording comprises the step of correcting the positional error during recording of said recording head in both directions.

56. A method according to claim 50, wherein the predetermined area is about ⅓ the recording area.

57. A method according to claim 50, wherein said recording head comprises a plurality of ejection ports for ejecting ink, and heat energy generating means, respectively arranged in correspondence with said plurality of ejection ports, for causing a change in state in the ink by heat and ejecting the ink from said ejection ports to form flying liquid droplets on the basis of the change in state.

58. A method according to claim 50, wherein said recording head is interchangeable with respect to a serial recording apparatus.

59. A serial recording apparatus for reciprocating a recording head with respect to a recording medium to perform bidirectional recording, said apparatus comprising:

driving means for reciprocating said recording head within a predetermined area of a recording area including a reference position, said driving means comprising a pulse motor driven by switching an exciting phase;

position detecting means for detecting a passage of the reference position by said recording head, said position detecting means performing the detection in accordance with a plurality of phases obtained by dividing the exciting phase;

means for calculating a difference in timing between the passages of reference positions detected by said position detecting means of movements in both directions, respectively, when said recording head is reciprocated by said driving means within the predetermined area, said calculating means calculating the difference in accordance with a plurality of phases obtained by dividing the exciting phase; and means for correcting a positional error in bidirectional recording on a basis of the difference calculated by said calculating means.

60. An apparatus according to claim 59, wherein said correcting means corrects the positional error on a basis of the difference calculated by said calculating means and a characteristic value of said driving means.

61. An apparatus according to claim 60, wherein the characteristic value of said driving means is based at least in part on play of said driving means.

62. An apparatus according to claim 60, wherein said driving means comprises circuitry and the characteristic value of said driving means is based at least in part on a delay in said circuitry of said driving means.

63. An apparatus according to claim 59, wherein said correcting means corrects the positional error on a basis of the difference calculated by said calculating means and a characteristic value based at least in part on a hysteresis of said position detecting means.

64. An apparatus according to claim 59, wherein said correcting means corrects the positional error while said recording head is moved for recording in one direction or the other direction.

65. An apparatus according to claim 59, wherein said correcting means corrects the positional error during movement of said recording head for recording in both directions.

66. An apparatus according to claim 59, wherein said driving means drives to reciprocate said recording head to cause said calculating means to calculate the difference between the detected reference positions upon a power-on operation.

67. An apparatus according to claim 59, wherein said driving means drives to reciprocate said recording head to cause said calculating means to calculate the difference between the detected reference positions in an on-line mode.

68. An apparatus according to claim 59, wherein the predetermined area is about ⅓ the recording area.

69. An apparatus according to claim 59, wherein said recording head comprises a plurality of ejection ports for ejecting ink, and heat energy generating means, respectively arranged in correspondence with said plurality of ejection ports, for causing a change in state in the ink by heat and ejecting the ink from said ejection ports to form flying liquid droplets on the basis of the change in state.

70. An apparatus according to claim 59, wherein said recording head is interchangeable with respect to said serial recording apparatus.

71. An apparatus according to claim 59, wherein said serial recording apparatus has a facsimile function which records facsimile information received through a communication line.

72. An apparatus according to claim 59, wherein said serial recording apparatus has a word processing function which records various information inputted through a keyboard.

73. An apparatus according to claim 59, wherein said serial recording apparatus has a copier function which records read original information.

74. An apparatus according to claim 59, further comprising computing means for computing and recording various information inputted through an input device.

75. A serial recording method of reciprocating a recording head with respect to a recording medium to perform bidirectional recording, said method comprising the steps of:

providing a recording head driving system to reciprocate said recording head in accordance with the switching of an exciting phase;

reciprocating said recording head within a predetermined area of a recording area including a reference position prior to recording;

detecting reference positions of movements in both directions, respectively, during reciprocal movement in accordance with a plurality of phases obtained by dividing the exciting phase and calculating a difference in timing of the detection of the reference positions; and correcting a positional error in order to perform bidirectional recording on a basis of the calculated difference.

76. A method according to claim 75, wherein said step of performing bidirectional recording comprises the step of correcting the positional error while said recording head performs recording in one direction or the other direction.

77. A method according to claim 75, wherein said step of performing bidirectional recording comprises the step of correcting the positional error during recording of said recording head in both directions.

78. A method according to claim 75, wherein the predetermined area is about ⅓ the recording area.

79. A method according to claim 75, wherein said recording head comprises a plurality of ejection ports for ejecting ink, and heat energy generating means, respectively arranged in correspondence with said plurality of ejection ports, for causing a change in state in the ink by heat and ejecting the ink from said ejection ports to form flying liquid droplets on the basis of the change in state.

80. A method according to claim 75, wherein said recording head is interchangeable with respect to a serial recording apparatus.

* * * * *

UNITED STATES PATENT AND TRADEMARK OFFICE

CERTIFICATE OF CORRECTION

PATENT NO. : 5,258,773

DATED : November 2, 1993

INVENTOR(S) : Junichi ARAKAWA, et al.

It is certified that error appears in the above-identified patent and that said Letters Patent is hereby corrected as shown below:

COLUMN 3:

Line 20, "An ink" should read --Ink--.

COLUMN 5:

Line 20, "correct-ion" should read --correction--;

Line 28, "are" should read --is--.

COLUMN 7:

Line 18, "X=(Q-P-Y/Z." should read --X=(Q-P-Y)/Z.--.

COLUMN 10:

Line 33, "a" should read --an--.

UNITED STATES PATENT AND TRADEMARK OFFICE

CERTIFICATE OF CORRECTION

PATENT NO. : 5,258,773

DATED : November 2, 1993

INVENTOR(S) : Junichi ARAKAWA, et al.

It is certified that error appears in the above-identified patent and that said Letters Patent is hereby corrected as shown below:

COLUMN 14:

Line 27, "pots" should read --ports--.

COLUMN 15:

Line 58, "are" (both occurrences) should read --area--.

Signed and Sealed this

Twenty-sixth Day of July, 1994

Attest:

Bruce Lehman

BRUCE LEHMAN

Attesting Officer

Commissioner of Patents and Trademarks